US008092191B2

(12) United States Patent
Lea-Wilson

(10) Patent No.: US 8,092,191 B2
(45) Date of Patent: Jan. 10, 2012

(54) CONTROL SYSTEM FOR RECIPROCATING DEVICE

(75) Inventor: Mark Lea-Wilson, Edmonton (CA)

(73) Assignee: Plainsman Mfg. Inc., Edmonton, Alberta (CA)

( * ) Notice: Subject to any disclaimer, the term of this patent is extended or adjusted under 35 U.S.C. 154(b) by 737 days.

(21) Appl. No.: 12/247,813

(22) Filed: Oct. 8, 2008

(65) Prior Publication Data

US 2009/0097985 A1 Apr. 16, 2009

Related U.S. Application Data

(60) Provisional application No. 60/979,912, filed on Oct. 15, 2007.

(51) Int. Cl.
*F04B 49/00* (2006.01)
*F01B 29/00* (2006.01)

(52) U.S. Cl. ..... 417/46; 417/26; 60/640; 91/420; 91/452; 92/9; 92/86; 92/143; 137/38

(58) Field of Classification Search ..... 91/303, 91/52, 420, 452, 454; 417/26, 46, 403; 92/9, 92/85 B, 86, 143; 60/639–640; 137/38, 137/43, 45–46, 102, 112
See application file for complete search history.

(56) References Cited

U.S. PATENT DOCUMENTS

| | | | | |
|---|---|---|---|---|
| 2,918,042 | A * | 12/1959 | Jensen et al. | 91/459 |
| 3,046,951 | A * | 7/1962 | Freeborn | 137/625.63 |
| 5,005,466 | A * | 4/1991 | Miyaoka | 91/420 |
| 6,038,956 | A * | 3/2000 | Lane | 91/409 |
| 7,320,272 | B2 * | 1/2008 | Zitterbart | 91/420 |
| 2004/0118274 | A1 * | 6/2004 | Morrison | 91/303 |
| 2004/0206229 | A1 * | 10/2004 | Morrison | 91/348 |

FOREIGN PATENT DOCUMENTS

| | | |
|---|---|---|
| CA | 2294410 | 1/2000 |
| CA | 2493340 | 2/2005 |

OTHER PUBLICATIONS

U.S. Appl. No. 12/203,497, filed Sep. 3, 2008, Mark Lea-Wilson.

* cited by examiner

*Primary Examiner* — Nimeshkumar D. Patel
*Assistant Examiner* — Jose M Diaz
(74) *Attorney, Agent, or Firm* — Bennett Jones LLP

(57) ABSTRACT

A control system for a reciprocating device which includes a switching valve for directing fluid supply under pressure to one of two drive lines in an alternating manner, means for alternating the switching valve, and an exhaust circuit including and exhaust outlet, a first flow restrictor disposed between one drive line and the exhaust outlet, and a second flow restrictor disposed between the other drive line and the exhaust outlet. The system may include a selection valve for alternately connecting one of two drivelines to the exhaust outlet.

7 Claims, 7 Drawing Sheets

CONTROL SYSTEM FOR RECIPROCATING DEVICE

CROSS REFERENCE TO RELATED APPLICATIONS

This application claims the priority benefit of U.S. Provisional Patent Application No. 60/979,912 filed on Oct. 15, 2007 entitled "Control System for Reciprocating Device", the contents of which are incorporated herein by reference.

FIELD OF THE INVENTION

The present invention relates to a control system for a reciprocating device for use in such applications as reciprocating drives, reciprocating actuators, reciprocating pumps, reciprocating power generators and other reciprocating devices commonly powered by fluid power.

BACKGROUND

Canadian Patent CA 2294410 (Lauder) and Canadian Patent Application CA 2493340 (Day) describe operational difficulties experienced by state of the art reciprocating devices used to power chemical injection pumps on oil and gas wells. At low operating speeds and low operating pressures, the reciprocating devices can stall and become stuck as the operating valve passes through the middle position. Lauder describes a solution for the reciprocating devices that utilizes fluid pressure to move the device in a first direction and a spring to move in it in a second direction. Day describes a similar device adapted to move the device in both the first and second directions using fluid power.

In the prior art, the fluid used to actuate reciprocating movement is vented to the atmosphere through an exhaust. Typically, the supply fluid pressure must be a minimum of about 8-10 p.s.i. to overcome the biasing spring and operate such injectors.

In some existing systems, end of stroke detectors such as a limit switch shifts a supply valve to alternately pressurize different chambers which causes the reciprocating motion. This method typically requires a minimum supply pressure of about 20-30 p.s.i. to shift the supply valve. This method also requires venting to the atmosphere. Where the supply fluid is compressed air, this is not an issue, however, if the supply fluid is casing or well gas, venting to the atmosphere may be uneconomical and environmentally detrimental.

Therefore, there is a need in the art for a method of reciprocation which allows low-pressure operation, and which may limit or reduce atmospheric emissions of the supply fluid.

SUMMARY OF THE INVENTION

In one aspect, the invention comprises a control system for a reciprocating device, the control system comprising:

(a) a switching valve having a fluid supply inlet, an exhaust outlet, a first drive line, and a second drive line, wherein the valve may alternative between a first position wherein the fluid supply inlet is connected to the first drive line and a second position wherein the fluid supply inlet is connected to the second drive line;

(b) means for alternating the valve from the first position to the second position;

(c) a reciprocating device that is operable to move in a first direction due to fluid pressure in the first drive line and a second, opposed, direction due to fluid pressure in the second drive line;

(d) an exhaust circuit providing fluid communication between the first drive line, the second drive line and the exhaust outlet, wherein said exhaust circuit comprises a first flow restrictor disposed between the first drive line and the exhaust outlet, and a second flow restrictor disposed between the second drive line and the exhaust outlet.

In one embodiment, one or both of the first and second flow restrictors comprises an restrictive orifice in the exhaust circuit.

In one embodiment, the exhaust circuit comprises a selector valve which is moveable between a first position wherein the first drive line is connected to the exhaust outlet, and a second position wherein the second drive line is connected to the exhaust outlet. This selector valve may comprise an air logic valve which selects the first position or the second position based on the pressure differential between the first drive line and the second drive line.

In one embodiment, the selector valve comprises a valve which functions as an "&" logic valve. In another embodiment, the selector valve comprises a valve which functions as an "OR" logic valve.

In another aspect, the invention may comprise a method of controlling the reciprocation of a reciprocating device, comprising the steps of:

(a) directing a fluid flow under pressure to a first flow line causing the reciprocating device to move in a first direction, while exhausting fluid from a second flow line to an exhaust outlet;

(b) directing the flow fluid under pressure to the second flow line causing the reciprocating device to move in a second direction, while exhausting fluid from the first flow line to the exhaust outlet;

(c) connecting the exhaust outlet to either the first or second flow line in an alternating pattern based on a pressure differential between the first flow line and the second flow line.

In one embodiment, the alternating pattern is created by action of an "&" logic valve, or an "OR" logic valve disposed between the first and second flow lines and the exhaust outlet.

BRIEF DESCRIPTION OF THE DRAWINGS

In the drawings, like elements are assigned like reference numerals. The drawings are not necessarily to scale, with the emphasis instead placed upon the principles of the present invention. Additionally, each of the embodiments depicted are but one of a number of possible arrangements utilizing the fundamental concepts of the present invention. The drawings are briefly described as follows.

DETAILED DESCRIPTION OF PREFERRED EMBODIMENTS

The present invention relates to a control system for a fluid-driven reciprocating device. When describing the present invention, all terms not defined herein have their common art-recognized meanings. To the extent that the following description is of a specific embodiment or a particular use of the invention, it is intended to be illustrative only, and not limiting of the claimed invention. The following description is intended to cover all alternatives, modifications and equivalents that are included in the spirit and scope of the invention, as defined in the appended claims.

Figure 1:
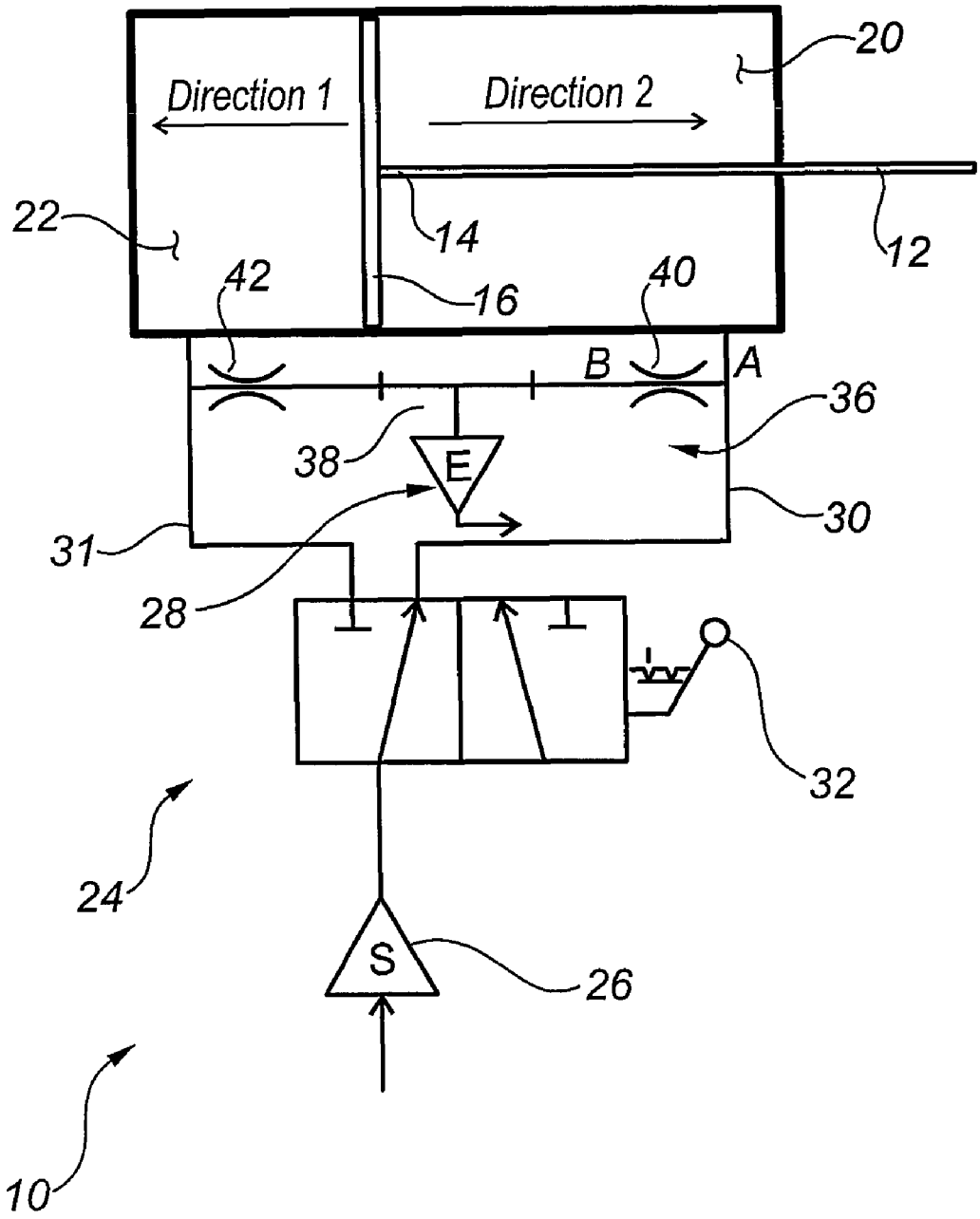
FIG. 1 is a schematic view of one embodiment of the present invention.

In one embodiment shown schematically in FIG. 1, the invention comprises a control system (10) for a reciprocating device. The reciprocating device has a reciprocating shaft (12) which reciprocates between a first direction and a second direction opposed to the first direction. In one preferred embodiment, the device reciprocates linearly. The first end (14) of the shaft is connected to a platen (16). The platen (16) divides a fluid retaining chamber thereby defining a first chamber (20) and a second chamber (22). In alternative embodiments, the platen may be replaced by a flexible diaphragm, a piston or a functionally similar mechanical arrangement.

The control system (10) includes a switching valve (24) having a fluid supply inlet (26), an exhaust outlet (28) and a first driveline (30) in fluid communication with the first chamber (20) and a second driveline (31) in fluid communication with the second chamber (22). The valve (24) is operable to connect either the fluid supply inlet (26) to one of the first or second drivelines (30, 31). In FIG. 1, the valve (24) is shown connecting the fluid supply inlet (26) to the first driveline (30).

The nature of the fluid chamber, and the means for actuating reciprocating motion of the shaft (12) is not an essential part of the present invention. Various alternative means will be apparent to those skilled in the art to translate fluid pressure from the valve (24) into reciprocating movement of the shaft (12). Furthermore, the reciprocating motion controlled by the valve (24) need not be linear.

The valve (24), when in a first position illustrated in FIG. 1, provides fluid communication from the fluid supply inlet (26) to a first driveline (30) that is connected to supply fluid to the first chamber (20), causing the shaft (12) to move in the first direction. When the valve (24) in a second position, the fluid supply inlet (26) is connected to the second driveline port (31), providing fluid communication with the second chamber (22), causing the shaft (12) to move in the second direction.

As the shaft moves in either the first direction or the second direction, means are provided to change the position of the valve as a result of movement of the shaft. Such means comprise a physical connection between the shaft and a valve control member. In one embodiment, a valve actuating mechanism (not shown) operates to switch the valve (24) from one position to the other. The mechanism may provide a physical linkage between the reciprocating shaft (12) and an actuating switch (32). One example of a physical linkage is as described in Applicant's co-owned U.S. patent application Ser. No. 12/203,497 filed on Sep. 3, 2008, entitled "Control System for Reciprocating Device", the contents of which, where permitted, are incorporated herein by reference.

The switching valve (24) comprises an exhaust circuit (36) which provides fluid communication between the first driveline the second driveline and the exhaust outlet (28), by means of a T-joint (38). A first flow restrictor (40) is provided between the T-joint and the first driveline and a second flow restrictor (42) is provided between the T-joint and the second driveline.

When the switching valve is in its first position, high pressure supply fluid fills the first chamber (20) through the first driveline (30) and pushes the shaft in the first direction. The first flow restrictor (40) causes pressure to build in the first chamber (20) rather than dissipate through the exhaust outlet (28). As the shaft moves in the first direction, lower pressure fluid in the second chamber (22) is expelled through the second flow restrictor (42) through the exhaust outlet (28). When the switching valve (24) switches, the process reverses and the second chamber (22) and the second driveline (31) becomes the high pressure side, while the first chamber (20) and the first driveline (30) becomes the low pressure side.

Figure 2:
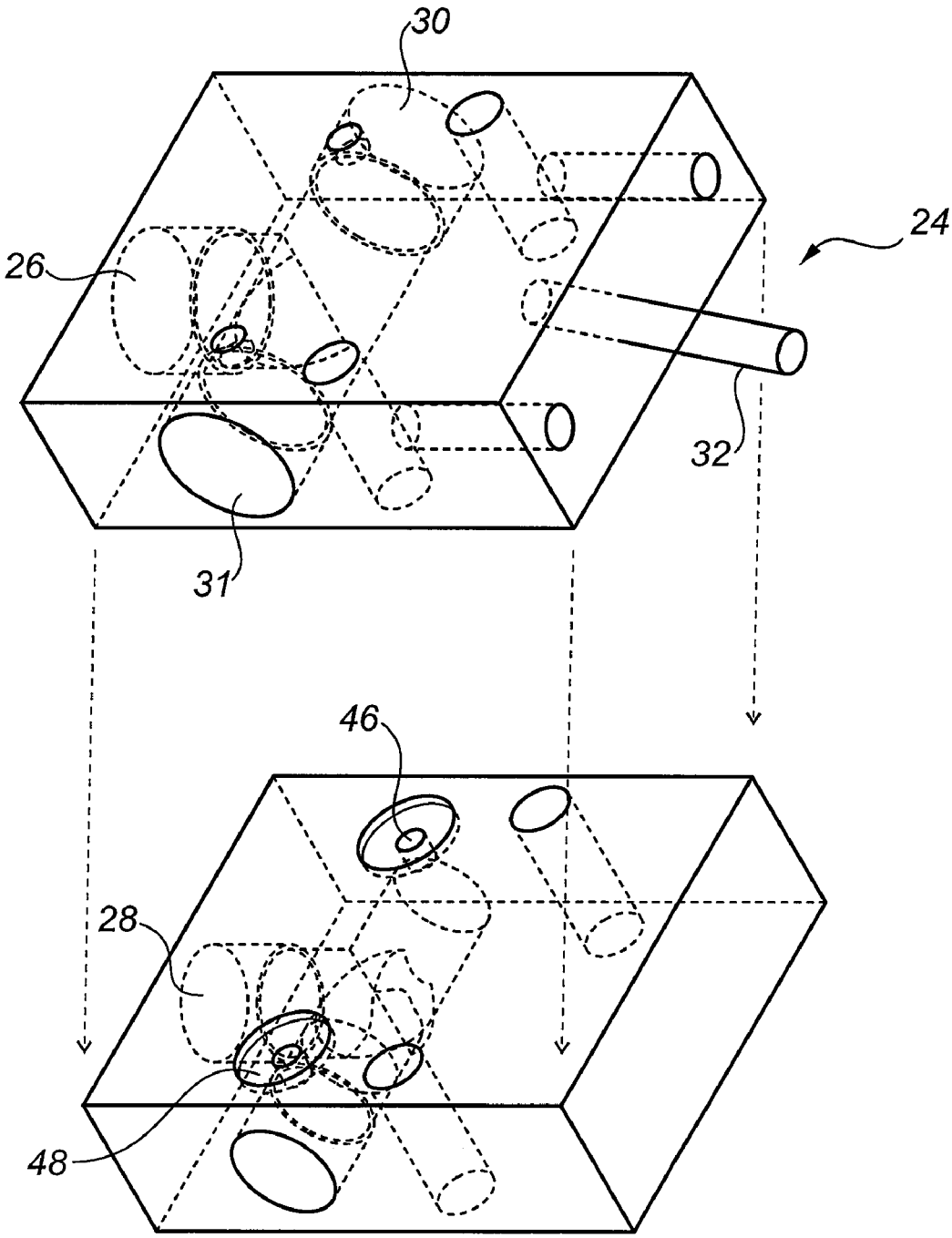
FIG. 2 shows an exploded view of a switching valve and an exhaust manifold.
Figure 3:
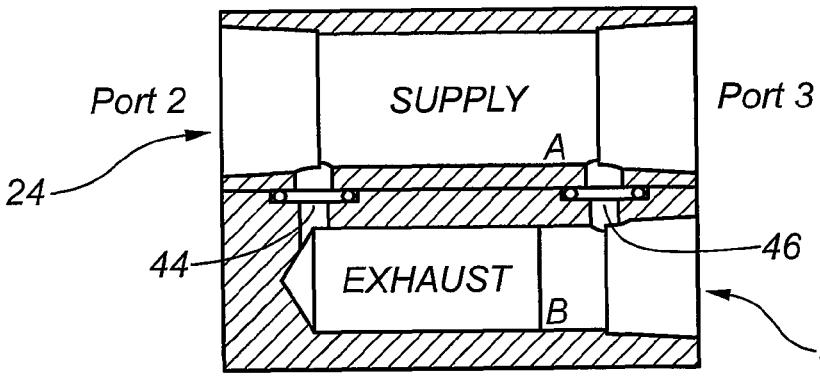
FIG. 3 shows a cross sectional view of a switching valve mounted to an exhaust manifold.

In one embodiment, as shown in FIGS. 2 and 3, the exhaust circuit (36) may be implemented with an exhaust manifold (44) which defines two restrictive orifices (46, 48) which act as the first and second flow restrictors. In this embodiment, the switching valve (24) may define ports which align the first and second drivelines (30, 31) with the orifices (46, 48).

The degree of flow restriction, which may be varied by orifice size in one embodiment, dictates the global flow rate through the switching valve, as well as the pressure drop between the high pressure delivery side, and the low pressure exhaust side. This of course will affect the overall reciprocation rate of the shaft (12).

Figure 4:
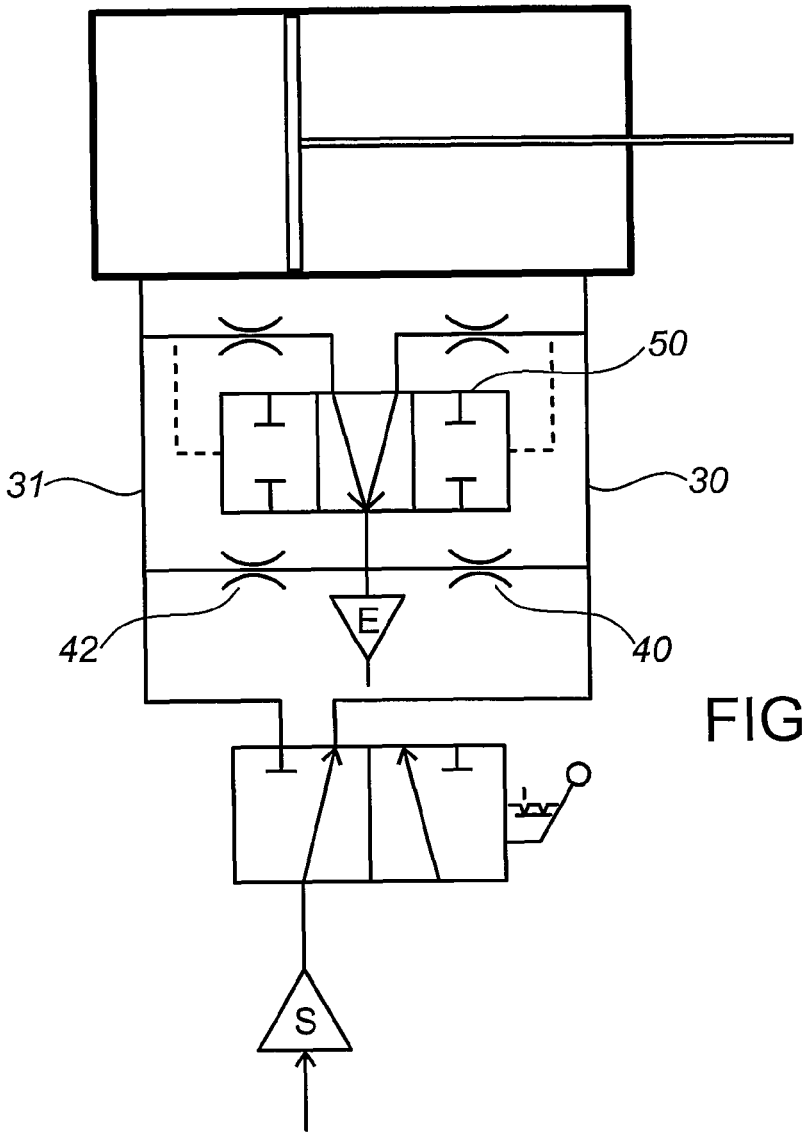
FIG. 4 shows a schematic view of another embodiment of the present invention.
Figure 5:
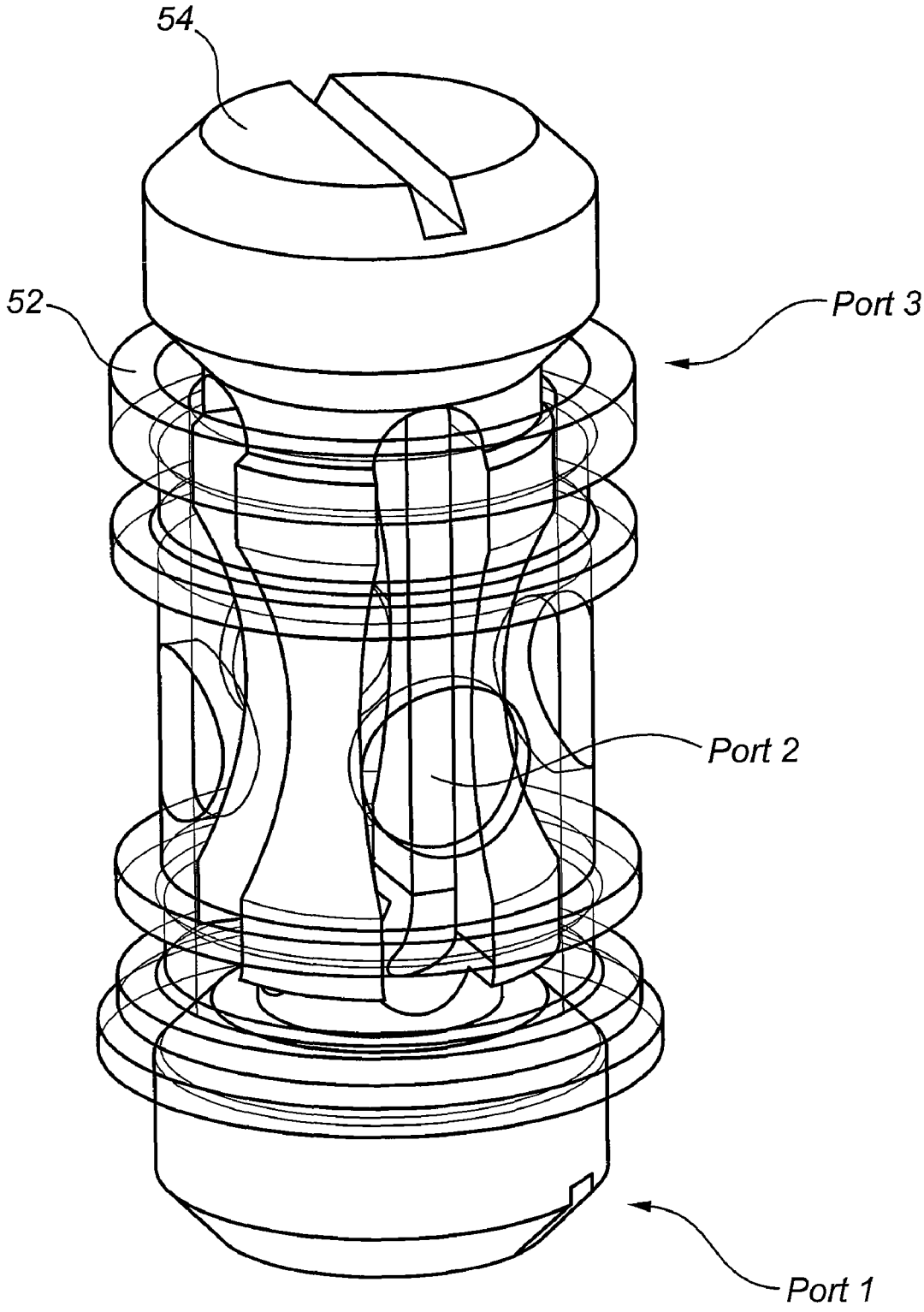
FIG. 5 shows a view of an air logic valve comprising a sleeve and poppet.
Figure 5A:
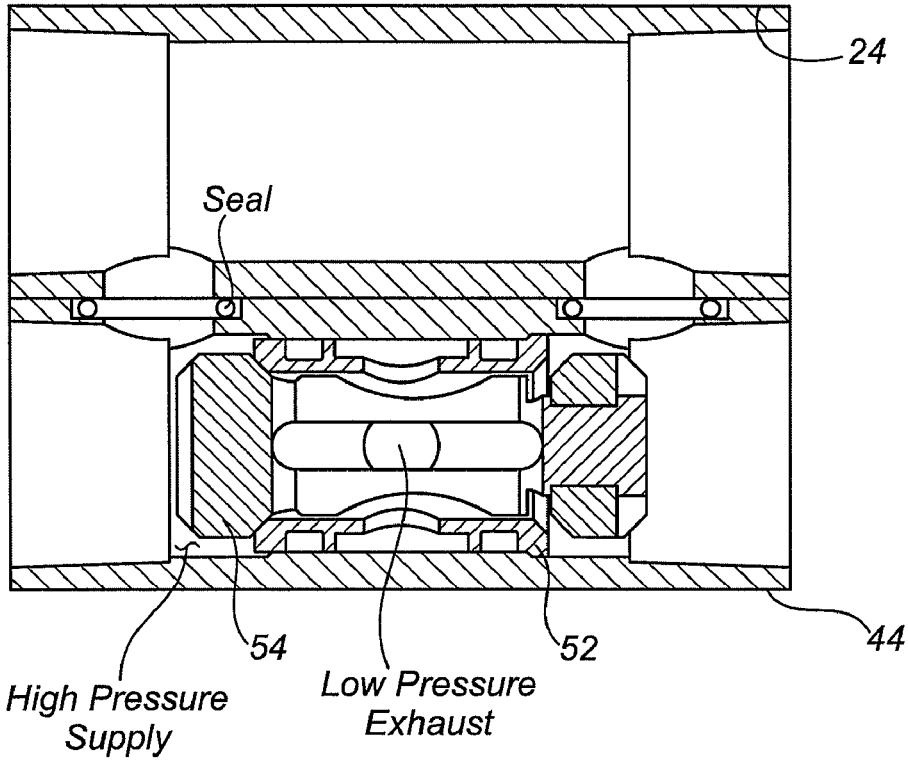
FIG. 5A shows a cross-sectional view of the sleeve and poppet in a first position.
Figure 5B:
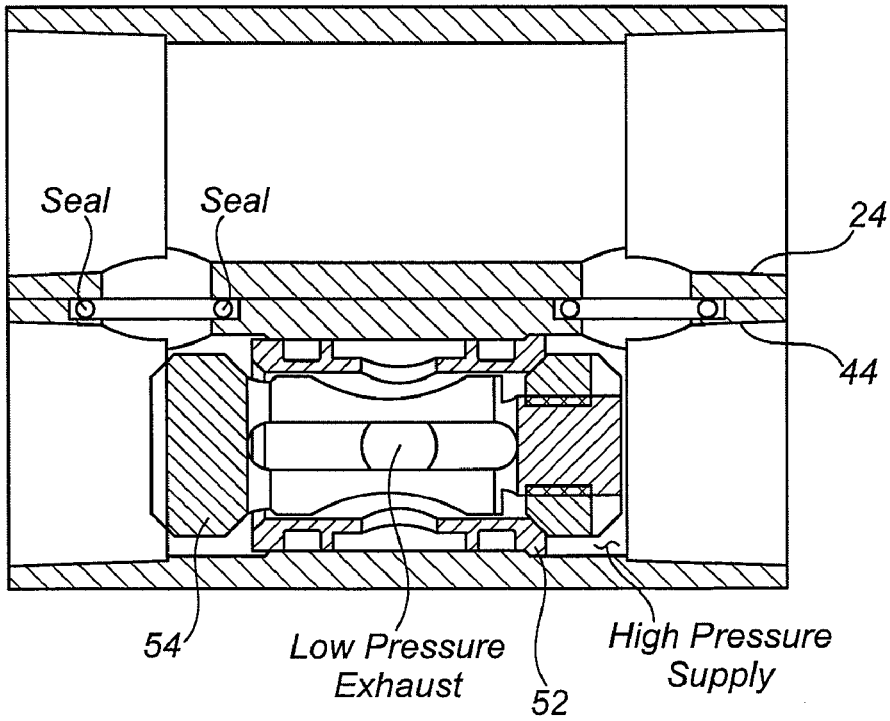
FIG. 5B shows a cross-sectional view of the sleeve and poppet in a second position.
Figure 5C:
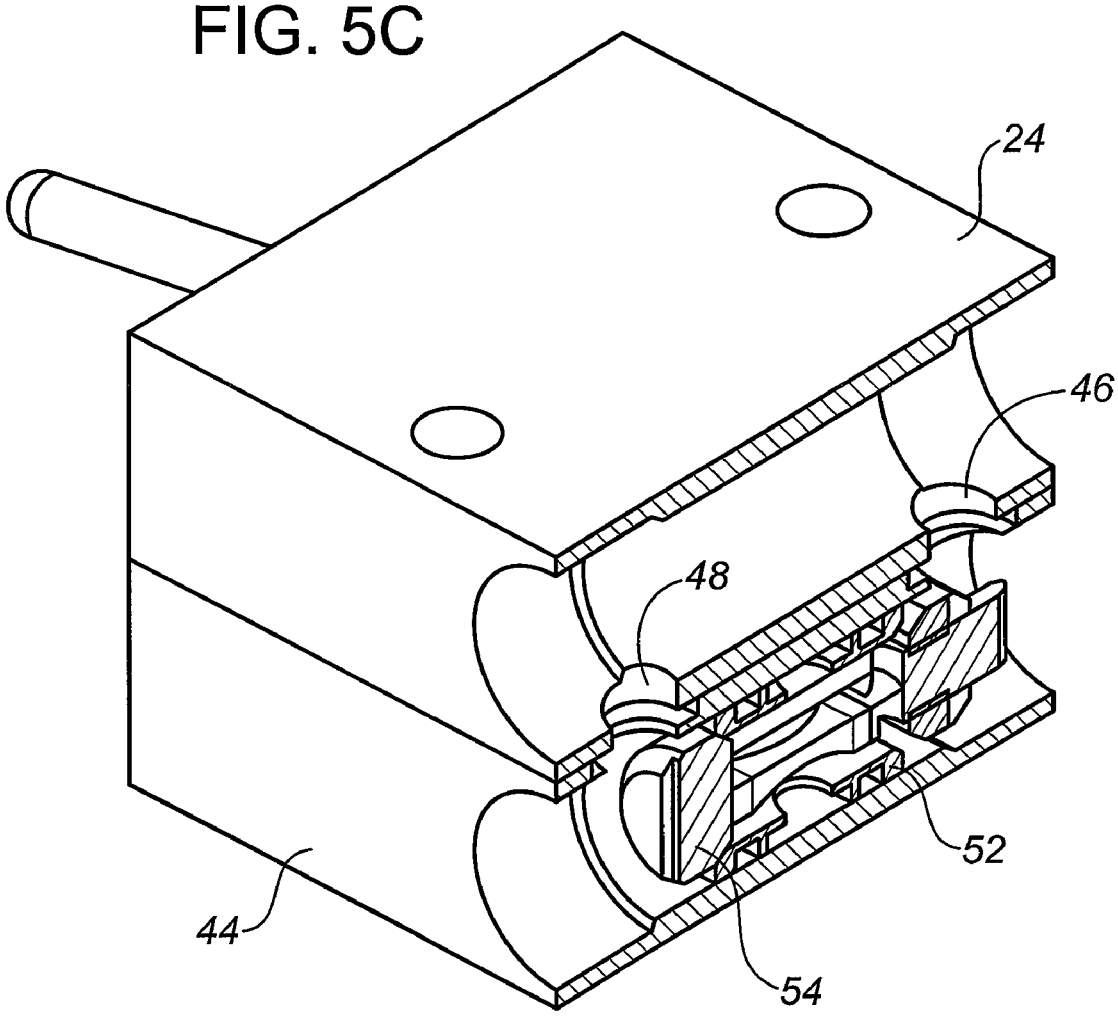
FIG. 5C shows a cross-sectional view of the switching valve mounted to an exhaust manifold comprising a sleeve and poppet valve.

In another embodiment, the exhaust circuit may further comprise a valve that functions in like manner to an air logic "&" valve (50), as shown schematically in FIG. 4. An "&" valve (50) functions to select and allow flow between two low pressure signals. In one embodiment, the "&" valve (50) may comprise a sleeve (52) and poppet (54) design, as shown in FIG. 5. The sleeve and poppet is inserted into a manifold (44) defining three ports. The sleeve defines three openings which correspond to the three ports of the manifold, while the poppet defines two ports. The poppet may move to block off one of the three sleeve openings, while providing fluid communication between the remaining two. Thus, when the poppet is in a first position, as shown in FIG. 5A, a port which connects to the first driveline (30) communicates with a port connected to the exhaust (28) and the port connected to the high pressure supply of the second driveline (31) is blocked. When the poppet is in a second position, as shown in FIG. 5B, the port connected to the second driveline (31) connects to the exhaust (28), while the port connected to the high pressure supply of the first driveline is blocked off. The position of the poppet is determined by the pressure differential between the two driveline connected ports, which causes the poppet to shift laterally within the sleeve, with the higher pressure port being blocked when the poppet shifts.

The sleeve and poppet "&" valve (50) thus selects the low pressure side, allowing it to flow to the exhaust. The flow restrictors (40, 42) are still required to cause the pressure drop, which allows the valve (50) to sense the pressure differential and shift position accordingly.

Figure 6:
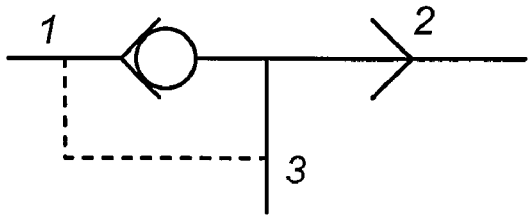
FIG. 6 shows a schematic of an air logic valve comprising a quick exhaust valve.
Figure 7:
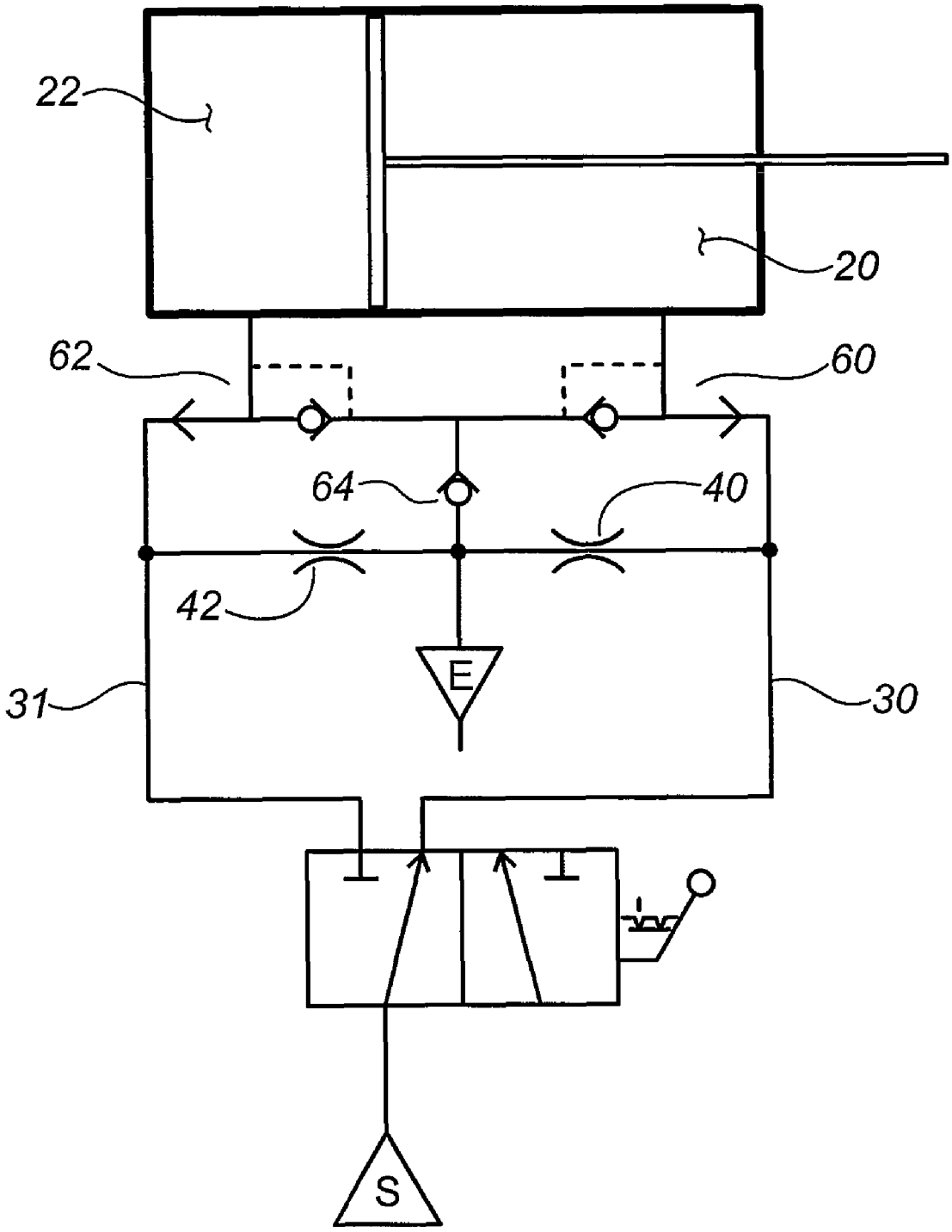
FIG. 7 shows a schematic of one embodiment of the present invention comprising quick exhaust valves.

In another embodiment, shown schematically in FIG. 7, utilizes a quick exhaust valve (60), shown schematically in FIG. 6. A quick exhaust valve functions in similar manner to an "OR" air logic valve (also known as a shuttle valve), with an additional pilot actuation in one direction. A shuttle valve works when pressure is applied to port 1, it allows communication to port 3. Pressure on port 2 connects it to port 3.

However, if pressure applies to ports 1 and 2 simultaneously, only the higher pressure signal communicates with port 3. If pressure is applied to port 3, it pilots the valve, allowing communication between ports 3 and 1, shown by the dashed line.

When quick exhaust valves (60, 62), or QEVs, are implemented into the exhaust circuit of the present invention, one directs high pressure supply fluid past the exhaust and into one of the chambers (20, 22), while the other allows the other chamber to drain quickly when fully opened.

With switching valve (24) in its first position, supply fluid is directed to the first driveline (30), as shown in FIG. 7. Pressure on port 2 of the first QEV (60) causes the valve to allow communication between the first driveline (30) and fluid chamber (20), because port 1 of the first QEV is connected to the exhaust (28), which by definition is at a lower pressure. Thus, port 1 of the first QEV (60) is blocked. Simultaneously, the second driveline (31) is blocked at valve (24) but the second flow restrictor (42) allows pressure of the second driveline (31) to bleed off and equalize with the lower pressure exhaust (28). Because the second chamber (22) is still at a higher pressure than the second driveline (31), it activates the pilot on the second QEV (62) and allows communication between port 1 and port 3. This allows the second chamber (22) to exhaust. As will be appreciated by those skilled in the art, when the switching valve is in its second position, the high and low pressure sides of the exhaust circuit reverse.

In one embodiment, a check valve (64) may be provided in the exhaust circuit, in order to prevent interference from the high pressure driveline with the operation of the low pressure QEV.

What is claimed is:

1. A control system for a reciprocating device, the control system comprising:

(a) a switching valve having a fluid supply inlet, an exhaust outlet, a first drive line, and a second drive line, wherein the valve may alternate between a first position wherein the fluid supply inlet is connected to the first drive line and a second position wherein the fluid supply inlet is connected to the second drive line;

(b) means for alternating the valve from the first position to the second position;

(c) a reciprocating device that is operable to move in a first direction due to fluid pressure in the first drive line and a second, opposed, direction due to fluid pressure in the second drive line;

(d) an exhaust circuit providing fluid communication between the first drive line, the second drive line and the exhaust outlet, wherein said exhaust circuit comprises a first flow restrictor disposed between the first drive line and the exhaust outlet, and a second flow restrictor disposed between the second drive line and the exhaust outlet.

2. The control system of claim 1 wherein the exhaust circuit comprises a "T" fitting connecting the first and second flow restrictors and the exhaust outlet.

3. The control system of claim 1 or 2 wherein the exhaust circuit further comprises an "&" logic valve, which selectively connects the first driveline to the exhaust, when the pressure in the first driveline is lower than the pressure in the second driveline, and selectively connects the second driveline to the exhaust, when the pressure in the second driveline is lower than the pressure in the first driveline.

4. The control system of claim 1 or 2, wherein the exhaust circuit further comprises a first quick exhaust valve which selectively connects the first driveline to the exhaust when the pressure in the second driveline is higher than the pressure in the first driveline, and a second quick exhaust valve, which functions oppositely to the first quick exhaust valve.

5. The control system of claim 3 wherein the "&" logic valve comprises a poppet and sleeve disposed within a valve manifold, wherein the poppet is slidably moveable within the sleeve to align ports connected to the first driveline, the second driveline and the exhaust.

6. The control system of claim 4 wherein one or both of the first and second quick exhaust valves comprises an "OR" logic valve.

7. The control system of claim 6 wherein the "OR" logic valve comprises a shuttle valve.

* * * * *